US009520033B2

(12) United States Patent
Freedman et al.

(10) Patent No.: US 9,520,033 B2
(45) Date of Patent: Dec. 13, 2016

(54) TRANSACTION MACHINE WITH MULTIPLE TRANSACTION ACCESS POINTS

(71) Applicant: Bank of America Corporation, Charlotte, NC (US)

(72) Inventors: James David Freedman, Charlotte, NC (US); Matthew Bryant, Gastonia, NC (US)

(73) Assignee: Bank of America Corporation, Charlotte, NC (US)

( * ) Notice: Subject to any disclaimer, the term of this patent is extended or adjusted under 35 U.S.C. 154(b) by 127 days.

(21) Appl. No.: 14/068,862

(22) Filed: Oct. 31, 2013

(65) Prior Publication Data

US 2015/0120040 A1 Apr. 30, 2015

(51) Int. Cl.
*G07F 19/00* (2006.01)

(52) U.S. Cl.
CPC ..... *G07F 19/203* (2013.01); *G07F 19/20* (2013.01); *G07F 19/202* (2013.01); *G07F 19/205* (2013.01)

(58) Field of Classification Search
CPC .... G07F 19/203; G07F 19/202; G07F 11/002; G07F 11/165; G07F 11/54; G07F 7/069; G07F 9/026; G07F 19/205; G07F 19/20
See application file for complete search history.

(56) References Cited

U.S. PATENT DOCUMENTS

| | | | | |
|---|---|---|---|---|
| 4,636,947 | A | 1/1987 | Ward | |
| 5,436,435 | A * | 7/1995 | McMillan | G07D 11/0015 235/379 |
| 7,195,153 | B1 * | 3/2007 | Green et al. | 235/379 |
| 7,712,657 | B1 | 5/2010 | Block et al. | |
| 2003/0066876 | A1 * | 4/2003 | Goldman | G06Q 20/4014 235/379 |
| 2007/0246531 | A1 * | 10/2007 | Dabrowski | G07F 17/3246 235/381 |
| 2012/0066097 | A1 * | 3/2012 | Amos | 705/28 |
| 2012/0278234 | A1 | 11/2012 | Dent et al. | |
| 2014/0314226 | A1 * | 10/2014 | Ordille | H04M 3/523 379/266.01 |

* cited by examiner

*Primary Examiner* — Sonji Johnson
(74) *Attorney, Agent, or Firm* — Banner & Witcoff, Ltd.; Michael A. Springs

(57) ABSTRACT

Aspects of the present disclosure are directed towards a transaction machine. The transaction machine may include a first transaction access point configured to provide a first set of transaction options and a second transaction access point configured to provide a second set of transaction options. An item cartridge may be shared between the first transaction access point and the second transaction access point. During a transaction, a routing mechanism may route an item from the item cartridge to an item dispenser of the first transaction access point or to an item dispenser of the second transaction access point.

20 Claims, 6 Drawing Sheets

TRANSACTION MACHINE WITH MULTIPLE TRANSACTION ACCESS POINTS

TECHNICAL FIELD

The present disclosure relates to transaction machines such as automated teller machines (ATMs).

BACKGROUND

In order to better service their customers, banks may install multiple automatic teller machines (ATMs) side-by-side at a common location. In these circumstances, each ATM may be a separate machine having its own individual inventory and its own individual set of components. As a result, the cost of each customer touch point may be multiplied by each machine installed. In addition, each machine installed may include the same set of transaction options. Thus users needing to perform a relatively quick transaction may need to wait if each machine is presently occupied by users engaged in transactions that take a relatively long amount of time to complete. Therefore, a need exists for improved transaction machines that can service multiple users in a convenient and cost-effective fashion.

SUMMARY

The following presents a simplified summary in order to provide a basic understanding of some aspects of the disclosure. The summary is not an extensive overview of the disclosure. It is neither intended to identify key or critical elements nor to delineate the scope of the claimed subject matter. The following summary merely presents some concepts in a simplified form as a prelude to the description below.

A first aspect described herein provides an automated teller machine (ATM). The ATM may include a housing having a first side facing a first direction and a second side facing a second direction different than the first directions. A first ATM transaction access point may be positioned at the first side of the housing, and a second ATM transaction access point may be positioned at the second side of the housing. The first ATM transaction access point may be configured to provide a first set of ATM transaction options. The second ATM transaction access point may be configured to provide a second set of ATM transaction options that consists of a withdrawal transaction option and a fast cash transaction option. A bill cartridge may be configured to provide bills to the first and second ATM transaction access points. During a transaction, the routing mechanism may be configured to route the bills to a bill dispenser of the first ATM transaction access point or to a bill dispenser of the second ATM transaction access point. A controller may be configured to control operation of the routing mechanism during the transaction.

A second aspect described herein provides a transaction machine. The transaction machine may include a first transaction access point configured to provide a first set of transaction options and a second transaction access point configured to provide a second set of transaction options. An item cartridge may be shared between the first transaction access point and the second transaction access point. During a transaction, a routing mechanism may route an item from the item cartridge to an item dispenser of the first transaction access point or to an item dispenser of the second transaction access point.

A third aspect described herein provides a method of providing transaction options at a transaction machine. A first set of transaction options may be displayed at a first transaction access point during a first transaction. A second set of transaction options may be displayed at a second transaction access point during a second transaction. An item may be retrieved from an item cartridge of the transaction machine. Whether the item is associated with the first transaction or the second transaction may be determined. A routing mechanism may route the item to an item dispenser of the first transaction access point or to an item dispenser of the second transaction access point based on the determination.

BRIEF DESCRIPTION OF THE DRAWINGS

The present disclosure is illustrated by way of example and not limited in the accompanying figures in which like reference numerals indicate similar elements.

DETAILED DESCRIPTION

Aspects of the present disclosure are directed towards transaction machines having multiple transaction access points. By providing multiple transaction access points, the transaction machine may advantageously service multiple users simultaneously. Additionally, the transaction access points of a transaction machine may offer different types of transaction options. One of the transaction access points may offer transaction options that may be completed in a relatively shorter period of time while another one of the transaction access points may offer transaction options that take a relatively longer amount of time to complete. In this way, the transaction machine advantageously allows users to perform relatively quick transactions at the transaction machine while another user performs a transaction that takes a relatively long amount of time to complete.

An automated teller machine (ATM) is one example of a transaction machine. Aspects of the disclosure provided below are described by way of example in the context of an ATM. It will be appreciated, however, that various aspects may be applicable to other types of transaction machines such as, for example, point-of-sale (POS) devices and other types of transaction machines that will be appreciated by those skilled in the art.

It is to be understood that the phraseology and terminology used herein are for the purpose of description and should not be regarded as limiting. Rather, the phrases and terms used herein are to be given their broadest interpretation and meaning. The use of "including" and "comprising" and variations thereof is meant to encompass the items listed thereafter and equivalents thereof as well as additional items and equivalents thereof. The use of the terms "mounted," "connected," "coupled," "positioned," "engaged" and similar terms, is meant to include both direct and indirect mounting, connecting, coupling, positioning and engaging. In addition, "set" as used in this description refers to a collection that may include one element or more than one element. Moreover, aspects of the disclosure may be implemented in non-transitory computer-readable media having instructions stored thereon that, when executed by a processor, cause the processor to perform various steps described in further detail below. As used in this description, non-transitory computer-readable media refers to all computer-readable media with the sole exception being a transitory propagating signal.

Figure 1:
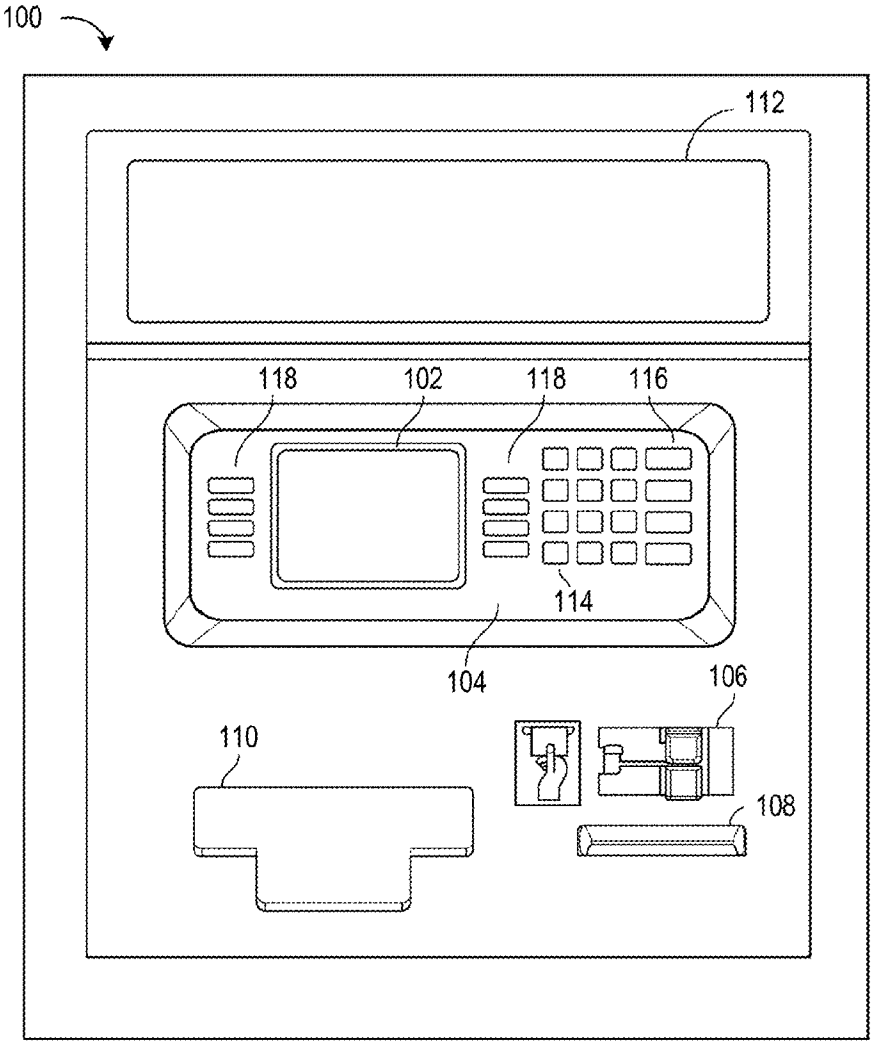
FIG. 1 is a front view of an example of an implementation of a first type of transaction access point.

Referring now to FIG. 1, a front view of an example of an implementation of a first type of transaction access point 100 is shown. The transaction access point 100, in this example, is a first type of ATM transaction access point. Accordingly, the ATM transaction access point 100, in this example, includes a display 102, a keypad 104, a card reader port 106, an item acceptor 108, an item dispenser 110 and a security screen 112. Not all of the components of the ATM transaction access point 100 are illustrated in FIG. 1. The ATM transaction access point 100 may include additional or alternative components that will be appreciated by those skilled in the art.

The display 102 may be, e.g., a monitor that exchanges visual information with a user. The display 102 may also receive input from the user via a touch screen of the display. The keypad 104 may include alphanumeric keys 114 for the user to enter numerical and textual data. The keypad 104 may also include control keys 116. In some embodiments, the control keys 116 may be used to communicate control information, such as instructions, to the ATM transaction access point 100. The keypad 104 may also include soft keys 118. The soft keys 118 may have functions that are dictated by programming and are presented to the customer using information that may be presented at the display 102.

The card reader port 106 may be the front end of any suitable card reader. The card reader may read magnetically encoded information on transaction instruments such as bank cards. The transaction instrument may also be a chip, a radio-frequency identification (RFID) tag, a smart card, a personal digital assistant (PDA), a mobile phone or any other device suitable to identify and authenticate the user. In some embodiments, the ATM transaction access point 100 may additionally or alternatively include a contactless chip reader, a wireless transceiver, a near field communications (NFC) transceiver, a barcode reader, or any other receiver or interface suitable for exchanging or receiving information from a transaction instrument or other electronic instrument. The information exchanged or received may include user identification information, user authentication information, transaction information, or any other information related to a transaction performed at the ATM transaction access point 100.

In some embodiments, the ATM transaction access point 100 may include a biometric sensor configured to identify a user based on a feature, such as a physiological feature, of the user. For example, the biometric sensor may be configured to identify the user based on all or part of a face, a fingerprint, an iris, a retina, a hand or any other physiological feature suitable to identify the user. The biometric sensor may also identify the user based on a behavioral feature such as a signature, a voice, a gait, or any other behavioral feature suitable to identify the user.

The item acceptor 108 may accept various types of items such as, for example, documents. The item acceptor 108 may, for example, accept envelopes, deposit forms, bills, checks, or any other documents related to a transaction performed at the ATM transaction access point 100. In some embodiments, the item acceptor 108 may feed into a scanner that digitizes the documents for image-based transaction processing. Examples of transactions associated with the item acceptor 108 include a deposit transaction and a bill pay transaction. In some example implementations, a transaction machine may include one item acceptor that can accept multiple types of media, while in other example implementations, a transaction machine may include multiple item acceptors that respectively accept distinct types of media. When the transaction machine is an ATM, for example, the ATM may include one item acceptor that accepts, e.g., both checks and cash; or the ATM may include two item acceptors, one item acceptor that accepts checks and another item acceptor that accepts cash.

The item dispenser 110 may dispense items from the ATM transaction access point 100. In some example embodiments, the item dispenser 110 may be a bill dispenser that dispenses bills from the ATM transaction access point 100. Example of transactions associated with the item dispenser 110 include a withdrawal transaction and a fast cash transaction. A withdrawal transaction refers to a transaction in which the user specifies an amount of cash to withdraw by inputting the amount at the ATM transaction access point 100, e.g., via the keypad 104. A fast cash transaction refers to a transaction in which the user selects an amount to withdraw, e.g. via the soft keys 118 or a touch screen of the display 102, from a set of predefined amounts (e.g., $20, $40, $60, $100) presented at the display.

The security screen 112 may visually screen a surveillance device (not shown). The surveillance device may provide video information about individuals that are present near the ATM transaction access point 100 and the conditions of the surrounding environment.

A user may activate an ATM session by providing user identification information—e.g., by inserting a bank card into the card reader port 106—and providing user authentication information—e.g., by typing in a personal identification number (PIN) at the keypad 104. Upon verification of the PIN, the display 102 of the ATM transaction access point 100 may present various ATM transaction options. Examples of ATM transaction options include a withdrawal transaction, a fast cash transaction, a deposit transaction, a balance inquiry transaction, an account transfer transaction, a bill pay transaction, and other types of transactions that may be performed by a user at an ATM. It will be recognized that a deposit transaction option or a bill pay transaction may take longer to perform relative to a withdrawal transaction option or a fast cash transaction option. It will also be appreciated that alternative types of transaction machine may provide alternative types of transaction options for alternative types of transactions.

Figure 2:
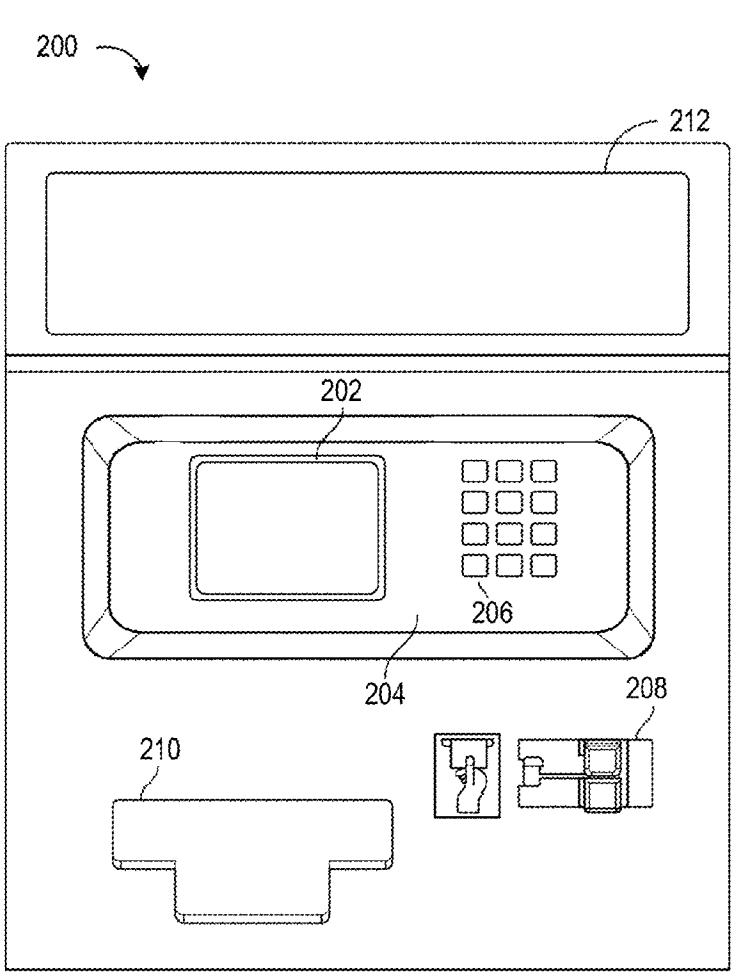
FIG. 2 is a front view of an example of an implementation of a second type of transaction access point.

In FIG. 2, a front view of an example of an implementation of a second type of transaction access point 200 is shown. The transaction access point 200, in this example, is a second type of ATM transaction access point. The ATM transaction access point 200, in this example, includes components similar to those of the ATM transaction access point 100 described above with reference to FIG. 1. In particular, the ATM transaction access point 200, in this example, includes a display 202, a keypad 204 having alphanumeric keys 206, a card reader port 208, an item dispenser 210, and a security screen 212.

The display 202 may be similar to the display 102 of FIG. 1. The keypad 204 and keys 206 may be similar to the keypad 104 and keys 114 of FIG. 1. The card reader port 208 may be similar to the card reader port 106 of FIG. 1. The item dispenser 210 may be similar to the item dispenser 110 of FIG. 1, and the security screen 212 may be similar to the security screen 112 of FIG. 1. As seen in FIG. 2, the ATM transaction access point 200 does not include all of the components included in the ATM transaction access point 100 of FIG. 1. For example, the ATM transaction access point 100 of FIG. 1 includes an item acceptor 108 while the ATM transaction access point 200 of FIG. 2 does not include an item acceptor. Accordingly, the ATM transaction access point 200 of FIG. 2 might not offer ATM transaction options that involve the use of an item acceptor, e.g., deposit transaction options or bill pay transaction options.

More generally, the ATM transaction access point 100 of FIG. 1 may offer a more comprehensive set of ATM transaction options relative to the ATM transaction access point 200 of FIG. 2, which may offer a less comprehensive set of ATM transaction options. The relatively less comprehensive set of ATM transaction options offered by the ATM transaction access point 200 may include those transactions that may be completed in a relatively shorter amount of time, e.g., a withdrawal transaction and a fast cash transaction. The relatively less comprehensive set of ATM transaction options offered by the ATM transaction access point 200 might not include those transactions that take a relatively longer amount of time to complete, e.g., a deposit transaction or a bill pay transaction. A set of transaction options refers to a collection of one or more transaction options.

The set of ATM transaction options offered by the ATM transaction access point 200 may, in some example embodiments, be a subset of the set of ATM transaction options offered by the ATM transaction access point 100. Stated differently, the ATM transaction access point 200 may offer ATM transaction options that the ATM transaction access point 100 also offers, but the ATM transaction access point 200 might not offer every ATM transaction option the ATM transaction access point 100 offers. As an example, the ATM transaction access point 100 may offer a set of ATM transaction options that includes a deposit transaction option, a withdrawal transaction option, a fast cash transaction option, a balance inquiry transaction option, an account transfer transaction option, and a bill pay transaction option; while the ATM transaction access point 200 may offer a subset of these ATM transaction options that only includes a withdrawal transaction option and a fast cash transaction option.

In other example embodiments, the ATM transaction access point 200 may offer a set of ATM transaction options that includes one or more ATM transaction options also offered by the ATM transaction access point 100 as well as one or more ATM transaction options not offered by the ATM transaction access point 100. As another example, the ATM transaction access point 100 may offer a set of ATM transaction options that includes a deposit transaction option, a withdrawal transaction option, a balance inquiry transaction option, an account transfer transaction option, and a bill pay transaction option; while the ATM transaction access point 200 offers a different set of ATM transaction options that includes a withdrawal transaction option and a fast cash transaction option. In further example embodiments, each of the ATM transaction options offered by the ATM transaction access point 100 may be different than the ATM transaction options offered by the ATM transaction access point 200. Various combinations of transaction options that may be offered by the ATM transaction access point 100 and the ATM transaction access point 200 will be appreciated with the benefit of this disclosure.

Figure 3:
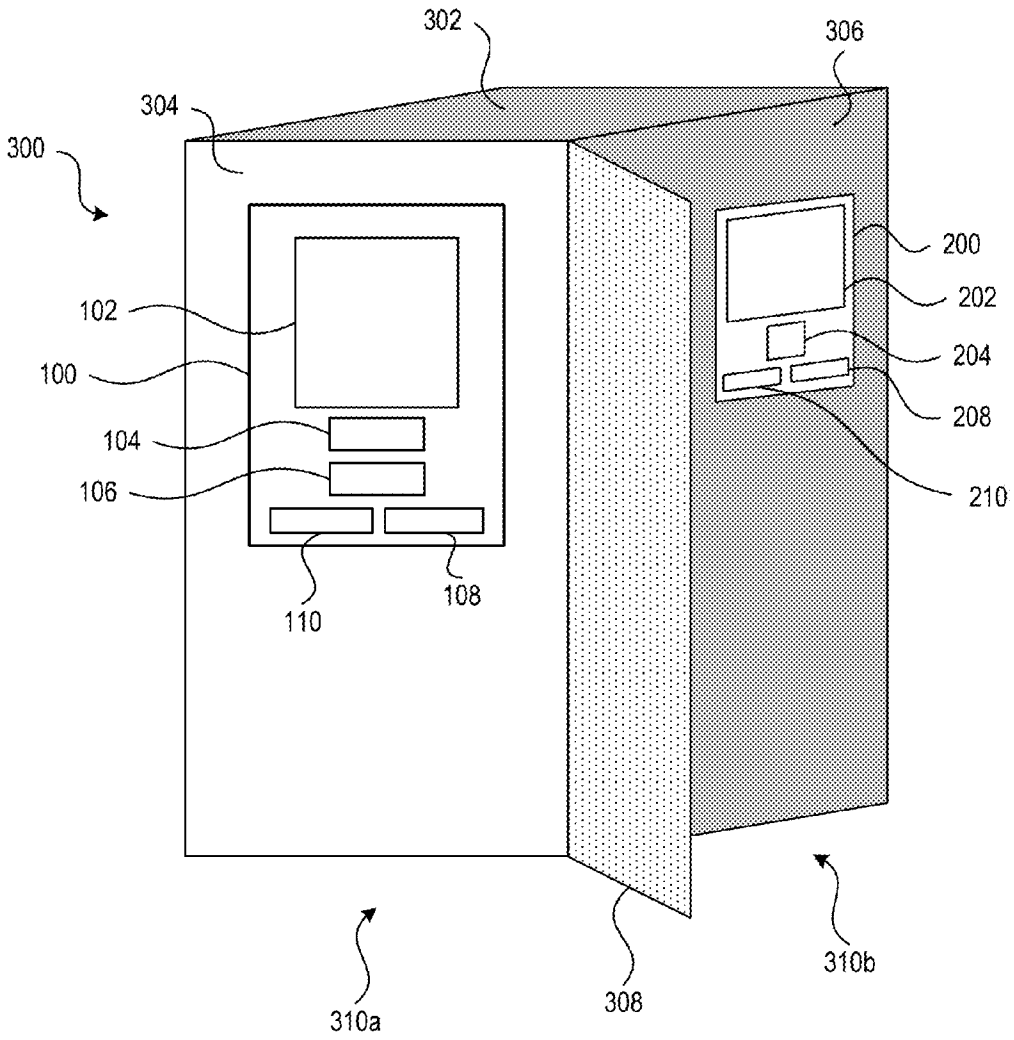
FIG. 3 is a perspective view of an example of an implementation of a transaction machine.

Referring now to FIG. 3, an example of an implementation of a transaction machine 300 is shown in a perspective view. The transaction machine 300, in this example, is an ATM. As seen in FIG. 3, the ATM 300, in this example, includes the ATM transaction access point 100 of FIG. 1 and the ATM transaction access point 200 of FIG. 2. In FIG. 3, some of the components of the ATM transaction access point 100 and the ATM transaction access point 200 have been omitted for the sake of clarity. In FIG. 3, the display 102, the keypad 104, the card read port 106, the item acceptor 108, and the item dispenser 110 of the ATM transaction access point 100 are shown. Similarly, the display 202, the keypad 204, the card reader port 208, and the item dispenser 210 of the ATM transaction access point 200 are shown in FIG. 3.

As also seen in FIG. 3, the ATM 300 includes a housing 302 having at least a first side 304 and a second side 306. The housing 302 of the ATM 300 may include additional sides not seen in the perspective view of FIG. 3. The housing 302 may, in some example implementations, enclose the internal components of the ATM 300. It will be appreciated, however, that a housing need not fully enclose the internal components of a transaction machine. For example, in some embodiments, a housing may shield the internal components of a transaction machine from one or more, but not all, directions. In some of these example embodiments, the internal components of a transaction machine may be enclosed by multiple elements that include a housing such as the housing 302.

The ATM transaction access point 100, in this example, is positioned on one side 304 of the housing 302, and the ATM transaction access point 200 is positioned on another side 306 of the housing. The sides 304 and 306 of the housing 302 may be positioned at an angle relative to one another such that the ATM transaction access points 100 and 200 face a different direction relative to one another. In some example implementations, the sides 304 and 306 of the housing 302 may be substantially orthogonal to each other such that the angle between the sides is about 90°. Accordingly, in these and some other example implementations, the side 304 of the housing 302 may be designated as a front side of the housing, and the side 306 of the housing may be designated as a lateral side of the housing. The sides 304 and 306 of the housing 302 may be alternatively oriented relative to one another. In other example implementations, for example, the sides 304 and 306 of the housing may be oriented relative to one another such that the angle between the sides is less than 90° or greater than 90°.

As described above, the example ATM 300 in FIG. 3 includes two ATM transaction access points 100 and 200. In some example implementations, a transaction machine may include more than two transaction access points. As an example, an ATM may include three ATM transaction access points located on three respective sides of a housing of the ATM, e.g., a front side of the housing, a left side of the housing, and a right side of the housing. The ATM transaction access point located at the front side of the housing, in this example, may be similar to the ATM transaction access point 100 described above and provide a relatively more comprehensive set of ATM transaction options. The ATM transaction access points respectively located at the left side and the right side of the housing, in this example, may be similar to the ATM transaction access point 200 described above and provide a relatively less comprehensive set of ATM transaction options.

The housing 302 of the example ATM 300 depicted in FIG. 3 includes four sides around its perimeter with two of those sides 304 and 306 seen in FIG. 3. It will be appreciated that, in other implementations, the housing may include more or less sides around its perimeter. In some example implementations, the housing of a transaction machine may include a transaction access point at each of its sides. In other example implementations, the hosing of a transaction machine may include a transaction access point at some, but not all, of its sides. Individual transaction access points of these example transaction machines may provide a relatively more comprehensive set of transaction options or a relatively less comprehensive set of transaction options as described above. Accordingly, a transaction machine may include a combination of one or more transaction access points that provide a relatively more comprehensive set of transaction options and one or more transaction access points that provide a relatively less comprehensive set of transaction options. Various examples may include: a transaction machine that includes one transaction access point providing a relatively more comprehensive set of transaction options and two transaction access points providing a relatively less comprehensive set of transaction options; a transaction machine that includes two transaction access points providing a relatively more comprehensive set of transaction options and one transaction access point providing a relatively less comprehensive set of transaction options; a transaction machine that includes two transaction access points that provide a relatively more comprehensive set of transaction options and two transaction access points that provide a relatively less comprehensive set of transaction options; and additional implementations of transaction machines that will be appreciated with the benefit of this disclosure. It will be appreciated that the number of users a transaction machine may simultaneously service advantageously increases as the number of transaction access points included in the transaction machine increases.

Referring back to FIG. 3, the ATM 300 in this example also includes a divider 308 attached to and extending away from the housing 302. As seen in FIG. 3, the divider 308 is positioned between the ATM transaction access points 100 and 200. In addition to functioning as a security screen to shield the activities of the users at the ATM transaction access points 100 and 200 from one another, the divider 308 also functions to define lanes 310*a* and 310*b* leading to the ATM transaction access points 100 and 200. The divider 308, in this example, defines lane 310*a* such that lane 310*a* leads to the ATM transaction access point 100 and defines lane 310*b* that leads to ATM transaction access point 200. In this way, the divider 308 advantageously signals a user that another ATM transaction access point is available at the ATM 300 via one of the lanes. In order to define the lanes 310*a-b* and sufficiently signal a user, the divider 308 may have a divider length of between about 16 inches (40.64 centimeters) and about 24 inches (60.96 centimeters). As seen in FIG. 3, the divider 308 may also have a divider height that is substantially the same as a housing height of the housing. Alternative divider lengths and alternative divider heights may be selectively employed. In addition, the divider 308, in this example, has a substantially rectangular shape. The dividers of alternative embodiments of a transaction machine may have alternative shapes, e.g., a shape that resembles a circular segment.

Figure 4:
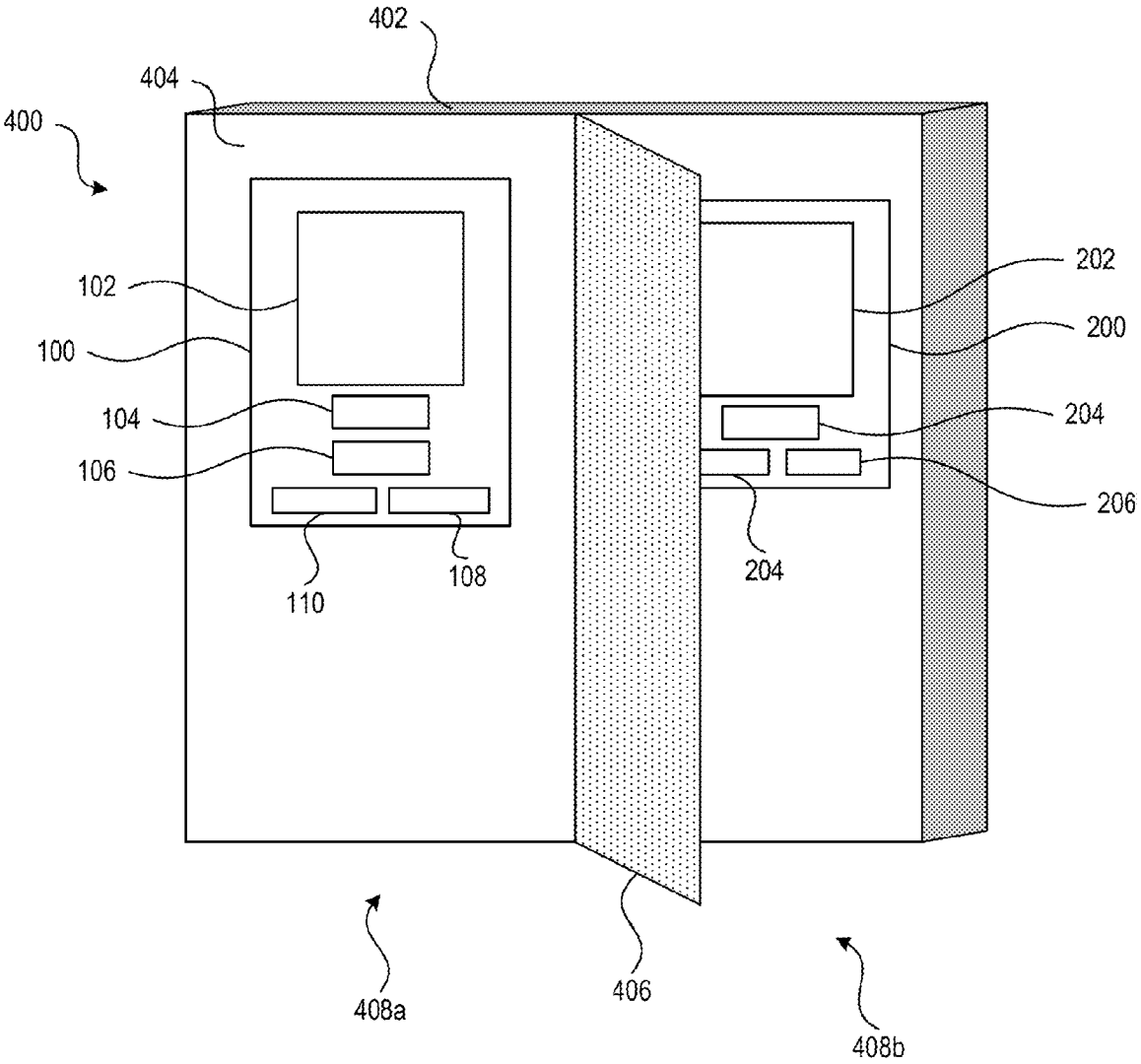
FIG. 4 is a perspective view of an example of another implementation of a transaction machine.

Referring now to FIG. 4, an example of another implementation of a transaction machine 400 is shown in a perspective view. The transaction machine 400 in FIG. 4 also includes a housing 402, a first transaction access point 100 (FIG. 1) and a second transaction access point 200 (FIG. 2). In this example transaction machine 400, the transaction access points 100 and 200 are positioned on a common side 404 of the housing 402, e.g., a front side of the housing, such that each of the transaction access points face a common direction. As described above, the first transaction access point 100 may provide a relatively more comprehensive set of transaction options while the second transaction access point 200 may provide a relatively less comprehensive set of transaction options. The transaction machine 400, in this example, similarly includes a divider 406 that may be similar to the divider 308 described above with reference to FIG. 3. The divider 406, in this example, may similarly define two lanes 408*a* and 408*b* respectively leading to the transaction access points 100 and 200 of the transaction machine 400. Additional and alternative configurations for the transaction machine as well as additional and alternative arrangements of the components of a transaction machine will be appreciated with the benefit of this disclosure.

Figure 5:
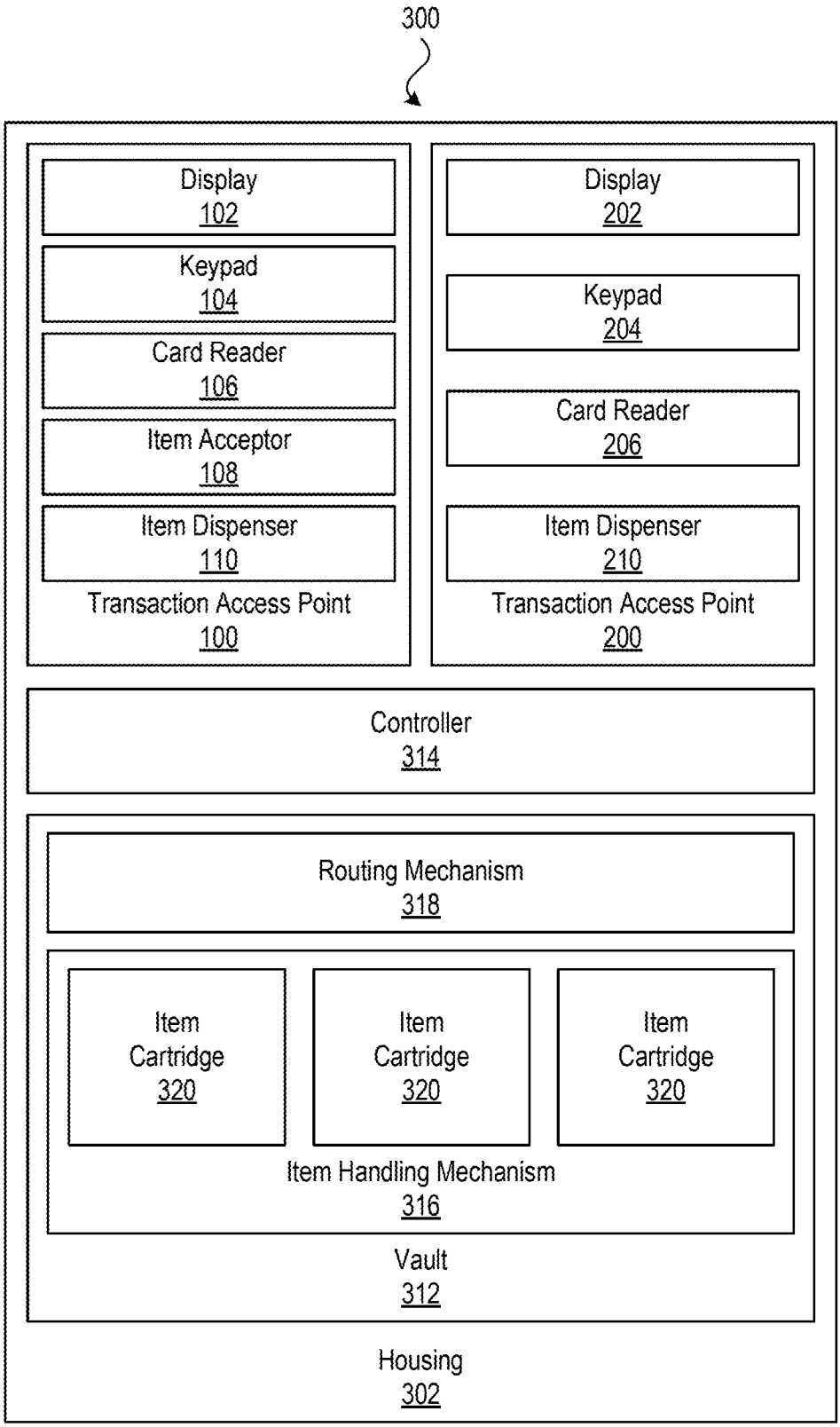
FIG. 5 is a block diagram of the transaction machine of FIG. 3.

Turning now to FIG. 5, a block diagram of the transaction machine 300 of FIG. 3 is shown. Accordingly, the transaction machine 300 includes a first transaction access point 100 (FIG. 1) and a second transaction access point 200 (FIG. 2). As seen in FIG. 3, the first transaction access point 100 includes an item acceptor 108 while the second transaction access point 200 lacks an item acceptor. Accordingly, the second transaction access point 200, in this example, might not provide a transaction option that involves accepting items (e.g., documents), and therefore might not include an item acceptor.

The transaction machine 300, in this example, may also include a vault 312 and a controller 314. The vault 312, in this example, may include an item handling mechanism 316 and a routing mechanism 318. The item handling mechanism 316 may include one or more item cartridges 320. Three item cartridges 320 are illustrated in FIG. 5. It will be appreciated, however, that alternative embodiments of transaction machines may include an alternative number of item cartridges.

The item cartridges 320 may be, e.g., bill cartridges that store multiple bills of respective denominations. As an example, one of the item cartridges 320 may store multiple $20 bills, one of the item cartridges may store multiple $50 bills, and one of the item cartridges may store multiple $100 bills. It will be appreciated with the benefit of this disclosure that the item cartridges 320 may store bills of alternative denominations or alternative currencies. The item cartridges 320 may also store alternative types of items. When the items are bills, the item cartridges 320 may be bill cartridges.

The item handling mechanism 316 may store, arrange, dispense or otherwise handle items for dispensing from the transaction machine 300. For example, the item handling mechanism 316 may include conveyors (not shown) for positioning and repositioning items for dispensing by the item dispensers 110 and 210. The routing mechanism 318 may be connected to the item handling mechanism 316 as well as the item dispenser 110 of the transaction access point 100 and the item dispenser 210 of the transaction access point 200 such that the routing mechanism defines respectively delivery pathways between the item cartridges and the item dispensers of the transaction access points. As seen in FIG. 3, each of the transaction access points 100 and 200, in this example, share the item cartridges 320 of the transaction machine 300. It will be appreciated that the routing mechanism 318 may be connected to and define pathways to each respective item dispenser of the transaction access points of a transaction machine.

The controller 314 may control the item handling mechanism 316 and the routing mechanism 318 during transactions in order to deliver items from the item cartridges 320 to the item dispensers 110 and 210 of the respective transaction access points 100 and 200. During a transaction, the controller 314 may instruct the item handling mechanism 316 to retrieve one or more items from one or more of the item cartridges 320. The item handling mechanism 316 may retrieve the items (e.g., bills) from the item cartridges 320 and provide the retrieved items to the routing mechanism 318. The controller 314 may determine which transaction access point 100 or 200 the retrieved items are associated with and instruct the routing mechanism 318 to route the retrieved items to one of the items dispensers 110 or 210 of the respective transaction access points 100 or 200.

The controller 314 may monitor the transactions performed at the transaction access points 100 and 200 and control the routing mechanism 318 during the transactions as described above. The controller 314 may include logic to determine which transaction access point 100 or 200 items retrieved from the item cartridges 320 should be routed and delivered to. The controller may thus utilize this logic to issue commands to the routing mechanism 318 to route the retrieved items to the appropriate transaction access point 100 or 200 or other transaction access points of alternative embodiments of the transaction machine.

The controller 314 may be, e.g., one or more central processing units (CPUs) that receive information from the keypads 104 and 204, card reader ports 106 and 208, item acceptor 108, item dispensers 110 and 210, and other components of the transaction access points 100 and 200 that will be appreciated by those skilled in the art. The controller 314 may control customer input/output, the item dispensing processes—which may include initialization, actuation, dispensing, receipt printing and dispensing—transaction channel communications, and other transaction-related processes.

Figure 6:
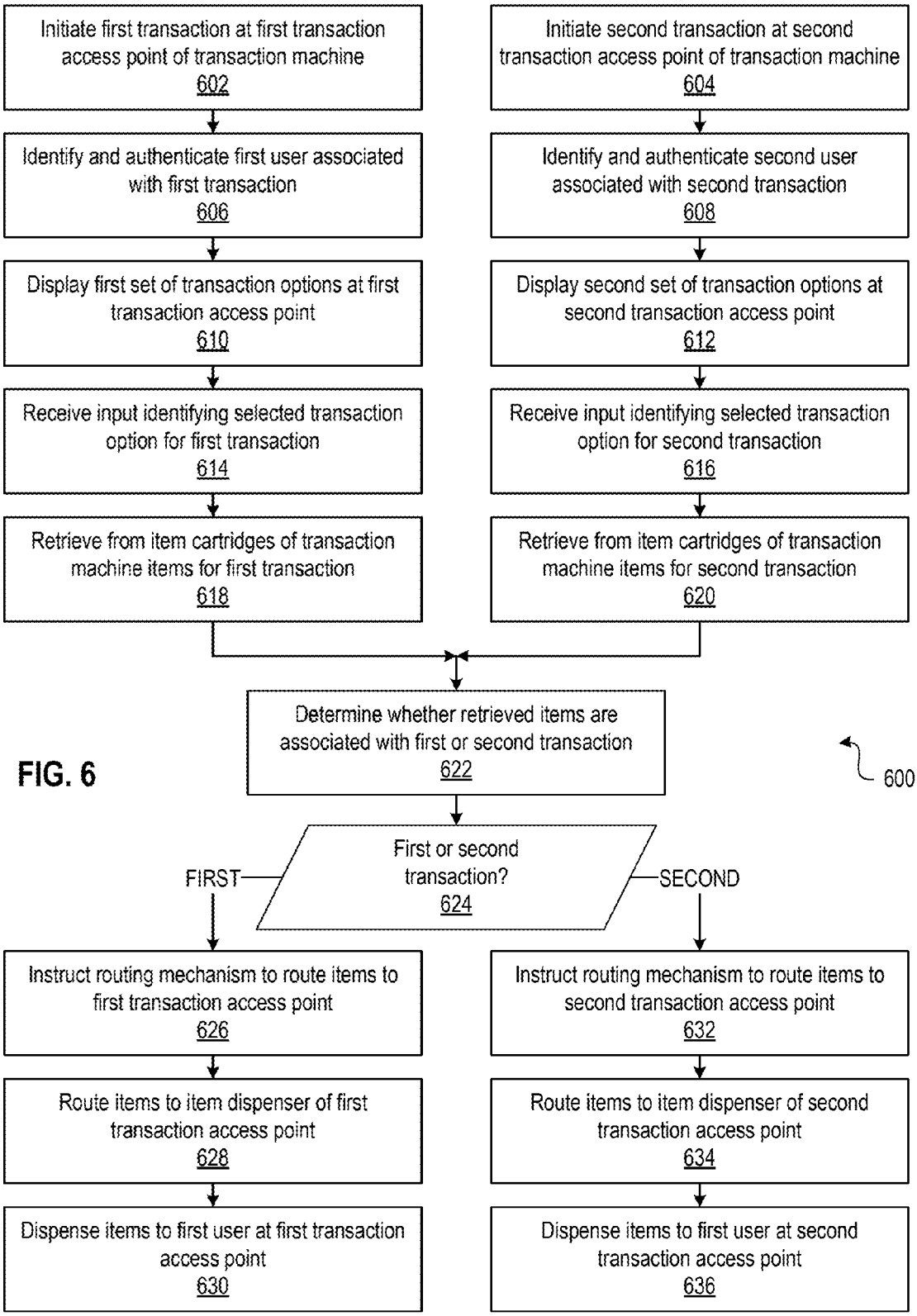
FIG. 6 is a flowchart of example method steps for handling transactions at a transaction machine having multiple transaction access points in accordance with various aspects described herein.

FIG. 6 is a flowchart 600 of example method steps for handling transactions at a transaction machine having multiple transaction access points in accordance with various aspects described above. The steps shown by way of example may occur concurrently as two users perform transactions at respective transaction access points of a transaction machine. A first user may initiate a first transaction at a first transaction access point of a transaction machine (block 602)—e.g., an ATM transaction access point of an ATM—and a second user may initiate a second transaction at a second transaction access point of the transaction machine (block 604). The controller of the transaction machine may identify and authenticate the first user associated with the first transaction (block 606), e.g., via a card read at the card reader and a PIN received from the first user. The controller of the transaction machine may similarly identify and authenticate the second user associated with the second transaction (block 608).

Once identified and authenticated, the first transaction access point may display a first set of transaction options to the first user (block 610), and the second transaction access point may display a second set of transaction options to the second user (block 612). As described above, the first set of transaction options may be a relatively more comprehensive set of transaction options (e.g., withdrawal, fast cash, deposit, balance inquiry, transfer, and so forth) while the second set of transaction options may be a relatively less comprehensive set of transaction options (e.g., withdrawal and fast cash). The first transaction access point may receive input from the user that identifies a selected transaction option for the first transaction (block 614), and the second transaction access point may receive input from the user that identifies a selected transaction option for the second transaction (block 616).

In this example, the selected transaction options may be a withdrawal transaction option and a fast cash transaction option. In response to receipt of the selected transaction options, the controller of the transaction machine may instruct the item handler to retrieve from the item cartridges one or more items for the first transaction (block 618) and to retrieve from the item cartridges one or more items for the second transaction (block 620). During a transaction, the controller of the transaction machine may determine whether items retrieved from the item cartridges are associated with a transaction performed at the first transaction access point or the second transaction access point (block 622).

If the controller determines that the retrieved items are associated with a transaction performed at the first transaction access point (block 624:FIRST), then the controller may instruct the routing mechanism of the transaction machine to route the retrieved items to the first transaction access point (block 626). In response to receipt of instructions from the controller, the routing mechanism may then route the retrieved items to the item dispenser of the first transaction access point (block 628), and the item dispenser may dispense the items to the first user (block 630).

If the controller determines that the retrieved items are associated with a transaction performed at the second transaction access point (block 624:SECOND), then the controller may instruct the routing mechanism of the transaction machine to route the retrieved items to the second transaction access point (block 632). In response to receipt of instructions from the controller, the routing mechanism may then route the retrieved items to the item dispenser of the second transaction access point (block 634), and the item dispenser may dispense the items to the second user (block 636).

Although the steps set forth above have been described in the context of withdrawal and fast cash transactions at an ATM, additional and alternative transactions and contexts will be appreciated with the benefit of this disclosure.

Aspects of the present disclosure may also be embodied in a kit for retrofitting an existing transaction machine with an additional transaction access point. In order to retrofit an existing transaction machine, the additional transaction access point may be provided and attached to, at, or within a side of a housing of an existing transaction machine. A routing mechanism may be installed at the transaction machine and connected to the item dispensers of the new transaction access point and the respective item dispensers of any existing transaction access points. The controller of the transaction machine may then be configured to determine which transaction access point an ongoing transaction is associated with and instruct the routing mechanism to route items retrieved from the item cartridges to the appropriate transaction access point. A controller configured to perform these steps may replace an existing controller of the transaction machine.

Figure 7A:
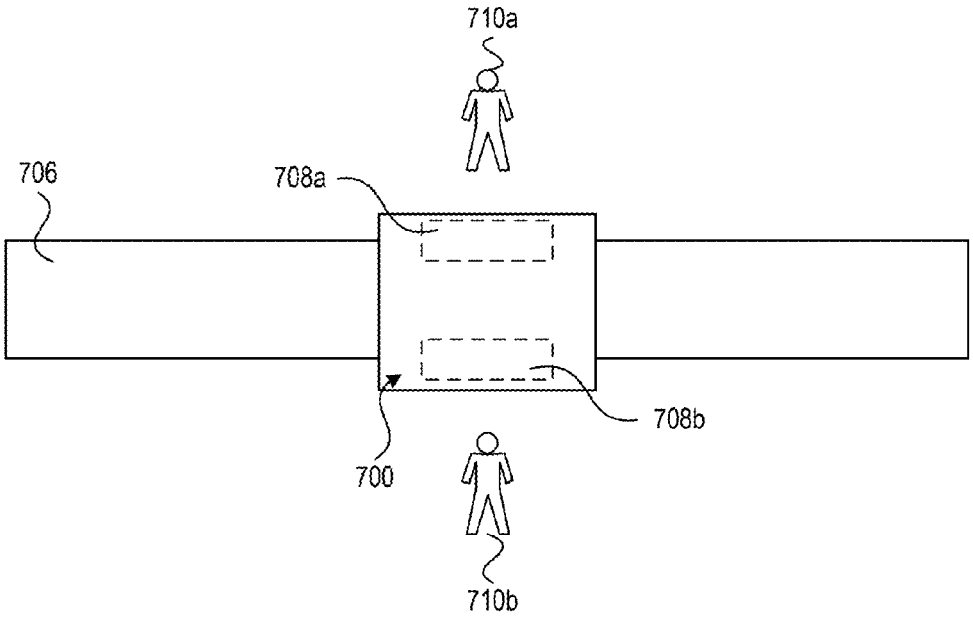
FIG. 7A is a top view of example of an alternative implementation of a transaction machine.
Figure 7B:
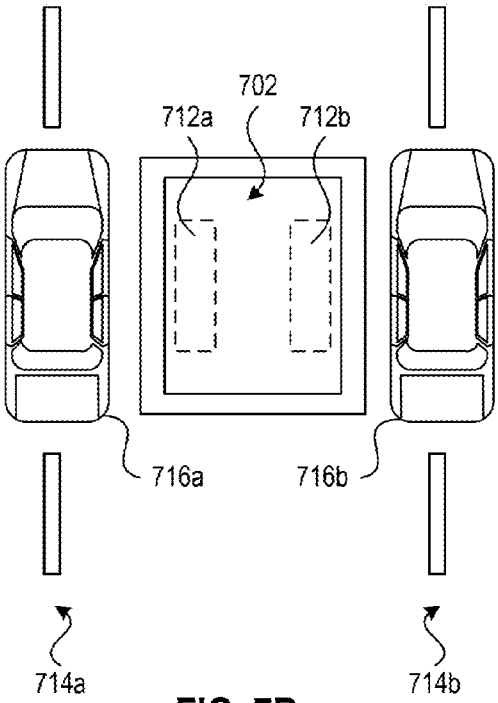
FIG. 7B is a top view of another example of an alternative implementation of a transaction machine.
Figure 7C:
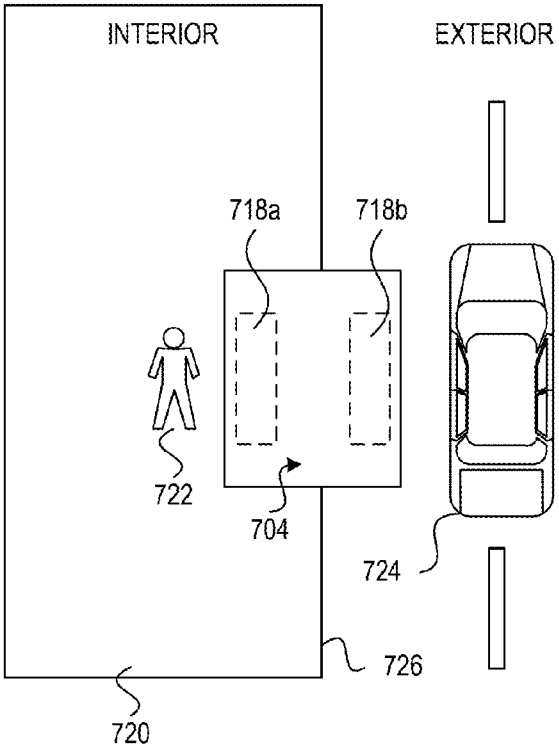
FIG. 7C is a top view of a further example implementation of a transaction machine.

Referring to FIGS. 7A-C, various top views of alternative implementations of transaction machines 700, 702, and 704 are shown. The transaction machines 702-704 may be similar to the transaction machines described above and include one or more of the features, elements, or components of the transaction machines described above. In FIG. 7A, the divider 706 of the transaction machine 700 is a wall that separates the transaction access point 708*a* and 708*b*. As seen in this example, the transaction access points 708*a* and 708*b* are positioned on opposite sides of the transaction machine 700 such that the transaction access points face away from each other. The divider 706 of the transaction machine 700 may separate the transaction access points 708*a* and 708*b* such that a user 710*a* at the transaction access point 708*a* is not aware of a user 710*b* at the transaction access point 708*b*.

Additionally, the example transaction machines described above are designed, oriented, and positioned for walk-up transactions in which a user walks up to the transaction machine to perform the transaction. It will be appreciated, however, that various aspects described above may be implemented in transaction machines designed, oriented, and positioned for drive-up transactions in which a user may drive up to a transaction machine in a vehicle in order to access the transaction machine from the vehicle. FIG. 7B illustrates a transaction machine 702 designed, oriented, and positioned for drive-up transactions. As seen in this example, the transaction access points 712*a* and 712*b* are positioned on opposite sides of the transaction machine 702 such that the transaction access points respectively face a drive-up lane 714*a* or 714*b*. In this way, a vehicle 716*a* may access the transaction access point 712*a* on one side of the transaction machine 702 while another vehicle 716*b* accesses the transaction point 712*b* on the other side of the same transaction machine. Transaction access points accessible from a vehicle when the vehicle is driven along a lane adjacent to the transaction access point may be referred to as drive-up transaction access points in this disclosure.

It will also be appreciated that a transaction machine may be designed, oriented, and positioned for both walk-up transactions and drive-up transactions. FIG. 7C illustrates a transaction machine 704 designed, oriented, and positioned for both walk-up and drive-up transaction machines. As seen in this example, the transaction machine 704 may include one transaction access point 718*a* on one side of the transaction machine that faces the interior of a banking center 720 and another transaction access point 718*b* that faces the exterior of the banking center when the transaction machine is installed at the banking center. A user 722 may thus walk up to the transaction access point 718*a* to perform a transaction at the transaction machine 704 while a vehicle drives up to the transaction access point 718*b* to perform a transaction at the same transaction machine. The divider 726, in this example, may thus be the wall of the banking center 720. It will be appreciated that, in some example implementations, a walk-up transaction access point and a drive-up transaction access point may both be located in an exterior environment. Transaction access points accessible by walking up to the transaction along a walking pathway leading to the transaction access point may be referred to as a walk-up transaction point in this disclosure.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

What is claimed is:

1. An automated teller machine (ATM) comprising:

a housing having a first side that faces a first direction and a second side that faces a second direction different than the first direction;

a first ATM transaction access point positioned at the first side of the housing and configured to provide a first set of ATM transaction options;

a second ATM transaction access point positioned at the second side of the housing and configured to provide a second set of ATM transaction options wherein the second set of ATM transaction options are a subset of the first set of ATM transaction options and includes only a withdrawal transaction option and a fast cash transaction option;

a bill cartridge configured to store bills of a denomination and provide the bills to the first ATM transaction access point and the second ATM transaction access point;

a routing mechanism configured to route at least one bill from the bill cartridge to one of a first bill dispenser of the first ATM transaction access point and a second bill dispenser of the second ATM transaction access point during a transaction; and a controller configured to control operation of the routing mechanism during the transaction.

2. The ATM of claim 1 wherein the first side of the housing is substantially orthogonal to the second side of the housing.

3. The ATM of claim 2 further comprising a divider attached to and extending away from the housing and positioned between the first ATM transaction access point and the second ATM transaction access point such that the divider defines a first lane leading to the first ATM transaction access point and a second lane leading to the second ATM transaction access point.

4. The ATM of claim 3 wherein the first ATM transaction access point includes an item acceptor and the second ATM transaction access point does not include an item acceptor.

5. The ATM of claim 4 wherein the controller is configured to:

determine whether the transaction is associated with the first ATM transaction access point or the second transaction access point;

instruct the routing mechanism to route the at least one bill to the first bill dispenser responsive to a determination that the transaction is associated with the first ATM transaction access point; and instruct the routing mechanism to route the at least one bill to the second bill dispenser responsive to a determination that the transaction is associated with the second ATM transaction access point.

6. A transaction machine comprising:

a first transaction access point that includes an item acceptor and is configured to provide a first set of transaction options that includes a deposit transaction option;

a second transaction access point that lacks an item acceptor and is configured to provide a second set of transaction options wherein the second set of transaction options is a subset of the first set of transaction options and includes only a withdrawal transaction option and a fast cash transaction option;

an item cartridge shared between the first transaction access point and the second transaction access point, the item cartridge storing items and providing items to a first item dispenser and a second item dispenser; and a routing mechanism configured to route an item from the item cartridge to one of the first item dispenser of the first transaction access point and the second item dispenser of the second transaction access point during a transaction.

7. The transaction machine of claim 6 further comprising:

a housing to which the first transaction access point is attached and to which the second transaction access point is attached; and a divider attached to and extending away from the housing and positioned between the first transaction access point and the second transaction access point such that the divider defines a first lane leading to the first transaction access point and defines a second lane leading to the second transaction access point.

8. The transaction machine of claim 7 wherein:

the housing has a first side that faces a first direction and a second side that faces a second direction different than the first direction; and the first transaction access point is positioned at the first side of the housing and the second transaction access point is positioned at the second side of the housing.

9. The transaction machine of claim 8 wherein the first side of the housing is substantially orthogonal relative to the second side of the housing.

10. The transaction machine of claim 7 wherein the first transaction access point and the second transaction access point are positioned on a common side of the housing such that the first transaction access point and the second transaction access point face a common direction.

11. The transaction machine of claim 6 wherein:

the first transaction access point is a first drive-up transaction access point accessible from a first vehicle driven along a first lane adjacent to the first drive-up transaction access point; and the second transaction access point is a second drive-up transaction access point accessible from a second vehicle driven along a second lane adjacent to the second drive-up transaction access point.

12. The transaction machine of claim 6 further comprising:

a controller configured to control operation of the routing mechanism during the transaction; and wherein controlling operation of the routing mechanism comprises determining whether a transaction involving the item is associated with the first transaction access point or the second transaction access point, instructing the routing mechanism to route the item to the first item dispenser responsive to a determination that the transaction is associated with the first transaction access point, and instructing the routing mechanism to route the item to the second item dispenser responsive to a determination that the transaction is associated with the second transaction access point.

13. The transaction machine of claim 6 wherein:

the first transaction access point is a drive-up transaction access point accessible from a vehicle driven along a lane adjacent to the drive-up transaction access point; and the second transaction access point is a walk-up transaction access point accessible to a user that walked up to the walk-up transaction access point along a pathway leading to the walk-up transaction access point;

wherein the drive-up transaction access point faces the exterior of a banking center and the walk-up transaction access point faces the interior of the banking center when the transaction machine is installed at the banking center.

14. The transaction machine of claim 6 wherein:

the first set of transaction options further includes a withdrawal transaction option, a fast cash transaction option, a balance inquiry transaction option, an account transfer transaction option, and a bill pay transaction option.

15. The transaction machine of claim 6 wherein the transaction machine is an automated teller machine (ATM), the item is a bill, the item cartridge is a bill cartridge, the first item dispenser is a first bill dispenser, and the second item dispenser is a second bill dispenser.

16. A method of providing transaction options at a transaction machine comprising:

displaying, during a first transaction, a first set of transaction options at a first transaction access point of the transaction machine wherein the first transaction access point includes an item acceptor and the first set of transaction options includes a deposit transaction option;

displaying, during a second transaction, a second set of transaction options at a second transaction access point of the transaction machine wherein the second transaction access point lacks an item acceptor and the second set of transaction options is a subset of the first set of transaction option and includes only a withdrawal transaction option and a fast cash transaction option;

retrieving an item from an item cartridge of the transaction machine, the item cartridge storing items and providing items to a first item dispenser of the first transaction access point and a second item dispenser of the second transaction access point;

determining whether the item is associated with the first transaction or the second transaction; and routing the item, using a routing mechanism of the transaction machine, to one of the first item dispenser of the first transaction access point and the second item dispenser of the second transaction access point based on the determination.

17. The method of claim 16 wherein:

the routing mechanism routes the item to the first item dispenser when the item is associated with the first transaction; and the routing mechanism routes the item to the second item dispenser when the item is associated with the second transaction.

18. The method of claim 16 further comprising:

positioning the first transaction access point at a first side of a housing of the transaction machine such that the first transaction access point faces a first direction; and positioning the second transaction access point at a second side of the housing such that the second transaction access point face a second direction that is different than the first direction.

19. The method of claim 18 further comprising positioning a divider that is attached to the housing of the transaction machine between the first transaction access point and the second transaction access point such that the divider defines a first lane leading to the first transaction access point and a second lane leading to the second transaction access point.

20. The method of claim 16 wherein:

the transaction machine is an automated teller machine (ATM); and the first set of transaction options further includes a withdrawal transaction option, a fast cash transaction option, a balance inquiry transaction option, and an account transfer transaction option.

* * * * *